US009312606B2

(12) United States Patent
Tanabe

(10) Patent No.: US 9,312,606 B2
(45) Date of Patent: Apr. 12, 2016

(54) ANTENNA DEVICE INCLUDING REFLECTOR AND PRIMARY RADIATOR

(75) Inventor: Kosuke Tanabe, Tokyo (JP)

(73) Assignee: NEC Corporation, Tokyo (JP)

( * ) Notice: Subject to any disclaimer, the term of this patent is extended or adjusted under 35 U.S.C. 154(b) by 58 days.

(21) Appl. No.: 14/239,529

(22) PCT Filed: Jul. 17, 2012

(86) PCT No.: PCT/JP2012/068106

§ 371 (c)(1),
(2), (4) Date: Feb. 18, 2014

(87) PCT Pub. No.: WO2013/031396

PCT Pub. Date: Mar. 7, 2013

(65) Prior Publication Data

US 2014/0218256 A1 Aug. 7, 2014

(30) Foreign Application Priority Data

Aug. 26, 2011 (JP) ..... 2011-184904

(51) Int. Cl.
*H01Q 19/13* (2006.01)
*H01Q 19/19* (2006.01)
(Continued)

(52) U.S. Cl.
CPC ..... *H01Q 19/19* (2013.01); *H01Q 15/16* (2013.01); *H01Q 19/026* (2013.01); *H01Q 19/13* (2013.01); *H01Q 19/132* (2013.01); *H01Q 19/192* (2013.01)

(58) Field of Classification Search
CPC ..... H01Q 19/13; H01Q 19/132; H01Q 19/19; H01Q 19/26; H01Q 19/192; H01Q 15/16
USPC ..... 343/837, 840
See application file for complete search history.

(56) References Cited

U.S. PATENT DOCUMENTS 4,250,508 A * 2/1981 Dragone ..... H01Q 19/192 343/779
4,801,946 A * 1/1989 Matz, Jr. ..... H01Q 19/13 343/840

(Continued)

FOREIGN PATENT DOCUMENTS

FR 1020553 A 2/1953
GB 1441222 A 6/1976

(Continued)

OTHER PUBLICATIONS

Extended European Search Report dated Mar. 11, 2015.

(Continued)

*Primary Examiner* — Lam T Mai
(74) *Attorney, Agent, or Firm* — McGinn IP Law Group, PLLC

(57) ABSTRACT

An antenna device includes a reflector which forms an offset antenna with a portion of a rotational paraboloid being cut out, and a primary radiator which radiates a beam having an elliptical cone shape to an aperture plane of the reflector. A reflector contour of the aperture plane of the reflector is formed in an elliptical shape along an isolux line of an elliptical beam radiated from the primary radiator. Accordingly, a loss due to spillover of the reflector is compensated for in a space in which the reflector contour of the present embodiment protrudes from a general reflector contour having a virtual elliptical shape formed to be perpendicular to an axis of a beam incident on an aperture plane of the reflector. In a space in which the general reflector contour protrudes from the reflector contour of the present embodiment, degradation of illuminance efficiency of the reflector is compensated.

9 Claims, 2 Drawing Sheets

(51) Int. Cl.
*H01Q 15/16* (2006.01)
*H01Q 19/02* (2006.01)

(56) References Cited

U.S. PATENT DOCUMENTS

| | | | | |
|---|---|---|---|---|
| 4,978,967 | A | 12/1990 | Masujima | |
| 5,977,923 | A * | 11/1999 | Contu | H01Q 19/192 343/761 |
| 6,188,370 | B1 * | 2/2001 | Lange | H01Q 15/16 343/840 |
| 6,198,457 | B1 * | 3/2001 | Walker | H01Q 1/005 343/840 |
| 6,215,453 | B1 * | 4/2001 | Grenell | H01Q 15/16 343/781 R |
| 6,331,839 | B1 * | 12/2001 | Grenell | H01Q 15/16 343/839 |
| 6,414,646 | B2 * | 7/2002 | Luh | H01Q 19/192 343/757 |
| 6,456,254 | B1 * | 9/2002 | Reineix | H01Q 15/148 343/840 |
| 6,833,819 | B2 * | 12/2004 | Lynch | H01Q 3/20 343/781 CA |
| 7,405,708 | B2 * | 7/2008 | Ahn | H01Q 19/193 343/781 CA |
| 7,911,403 | B2 * | 3/2011 | Berejik | H01Q 1/185 343/757 |

FOREIGN PATENT DOCUMENTS

| | | | |
|---|---|---|---|
| GB | 2001476 | A | 1/1979 |
| JP | 52-61458 | | 5/1977 |
| JP | 54-79542 | A | 6/1979 |
| JP | 61-169004 | A | 7/1986 |
| JP | 3-145806 | A | 6/1991 |
| JP | 09-51211 | A | 2/1997 |
| JP | 2592646 | B2 | 3/1997 |
| JP | 11-103214 | A | 4/1999 |
| RU | 2 236 727 | C1 | 9/2004 |
| RU | 2 380 802 | C1 | 1/2010 |

OTHER PUBLICATIONS

International Search Report in PCT/JP2012/068106 dated Sep. 4, 2012 (English Translation Thereof).

Katsuhiko Aoki et al., Improvement of Sidelobe Characteristics of Offset Dual Reflector Antenna with Elliptical Beam IEICE, B-II, vol.J81-B-II, No. 8 pp. 789-796, 1998, Aug. 25 (Partial translation thereof).

Russian Notice of Allowance dated Jan. 12, 2016 in co-pending Application No. 2014109750 with an English translation thereof.

* cited by examiner

ANTENNA DEVICE INCLUDING REFLECTOR AND PRIMARY RADIATOR

TECHNICAL FIELD

The present invention relates to an antenna device used for a point-to-point communication system such as a mobile backhaul, and more particularly, to an antenna device of a single beam scheme which radiates a beam in one direction from one antenna.

BACKGROUND ART

An antenna device such as a parabolic antenna is widely used for, for example, a mobile backhaul known as an RAN (Radio Access Network) which connects a wireless base station with a trunk network. Particularly, in the mobile backhaul, an antenna device of a single beam scheme which radiates a beam in one direction using a reflector and one primary radiator is widely used.

An offset parabolic antenna configured to reduce probability of reception of unnecessary radio waves only using a portion of the reflector of the parabolic antenna is often used as such an antenna device of a single beam scheme.

For example, technology of an offset parabolic reflector adapted not to receive unnecessary radio waves by reducing an aperture plane of a reflector is disclosed in Patent Document 1 as related technology for an antenna device including a reflector antenna of a single beam scheme. According to this technology, in the offset parabolic reflector formed in a shape in which a portion of a rotational parabolic reflector is cut, the reflector is formed so that a shape when a peripheral portion is viewed from a focus position of the offset parabolic reflector is substantially circular. In other words, while spillover (leakage) in a long axis direction increases in an elliptical reflector, it is possible to suppress the spillover to be low and achieve uniformity of an irradiation level in the peripheral portion of the reflector by causing the shape when the peripheral portion is viewed from the focus position of the reflector to be circular. As a result, it is possible to improve irradiation efficiency of the reflector.

Further, for example, technology for a method of realizing a low side lobe characteristic of an offset elliptical beam antenna has been reported in Non-Patent Document 1 as related technology of the offset parabolic reflector.

Further, for example, technology for causing a shape of a contour of a reflector to be a shape along a contour line corresponding to an aperture plane phase deviation caused by a mirror surface aberration in an antenna of a multi-beam scheme which radiates a beam in a plurality of directions from one antenna is disclosed as another related technology in Patent Document 2. According to this technology, it is possible to suppress deterioration of a beam directional characteristic, increase of a side lobe (leaked electromagnetic waves), and reduction of an antenna gain caused by a mirror surface aberration (i.e., a path difference of radio waves due to a difference in reflection position in a mirror surface) by forming the contour of the reflector along the contour line obtained by the mirror surface aberration.

DOCUMENTS OF THE PRIOR ART

Patent Documents

[Patent Document 1] Japanese Examined Patent Application Publication No. 2592646

[Patent Document 2] Japanese Unexamined Patent Application Publication, First Publication No. H9-51211

Non-Patent Document

[Non-Patent Document 1] Katsuhiko Aokio et al., "Method of Realizing Low Side Lobe Characteristic of Offset Elliptical Beam Antenna," B-II, Communication II-Wireless Communication and Wireless Application J81-B-2(8), 789-796, 1998-08-25, The Institute of Electronics, Information and Communication Engineers.

DISCLOSURE OF INVENTION

Problems to be Solved by the Invention

Generally, in a reflector antenna (antenna device) including a reflector and a primary radiator, if a width of the beam of the primary radiator is wide, an illuminance distribution of the aperture plane of the reflector approaches a uniform distribution state and irradiation efficiency is improved. However, there is a disadvantage that, since the width of the beam is wide, a portion of the beam does not hit the reflector and power which is spillover (leakage) increases, which is a loss. On the other hand, if the width of the beam of the primary radiator is narrow, the loss due to the spillover can be reduced, but irradiation efficiency may be degraded since the illuminance distribution in the aperture plane of the reflector is not uniform. Therefore, it is necessary to appropriately design the width of the beam irradiated from the primary radiator so that a trade-off relationship between the irradiation efficiency and the loss due to the spillover in the aperture plane of the reflector is optimized, in order to maximize the irradiation efficiency for the antenna device.

For example, when a reflector including an ideal rotational paraboloid and a primary radiator radiating a beam exhibiting an ideal Gaussian distribution characteristic (normal distribution characteristic) are used, the width (thickness) of the beam of the primary radiator is determined so that an illuminance of the contour portion relative to illuminance (0 dB) of a center of the reflector is generally about −12 dB. In this case, the trade-off relationship between the spillover of the reflector and the irradiation efficiency of the aperture plane of the reflector is optimized, and the irradiation efficiency for the antenna device exhibits a maximum value.

However, since the shape of an aperture plane in the general offset antenna with a reduced side lobe characteristic is an elliptical shape, illuminance strength from the primary radiator in the contour of the reflector does not have a constant value, and unevenness (strength and weakness) occurs. Therefore, it is not possible to optimize the trade-off relationship between the loss due to the spillover and enhancement of the irradiation efficiency even if the width of the beam of the primary radiator is varied. In other words, there is a problem in that it is difficult to maximize the irradiation efficiency for the antenna device.

Further, there is another problem in that the loss due to the spillover is still large since the illuminance in the contour portion of the elliptical aperture plane is not constant even when the illuminance in the contour portion of the reflector is set to be low, in order to realize the low side lobe characteristic for reducing leakage of electromagnetic waves from the reflector.

Further, it is necessary to have an elliptical shape in which the horizontal width of the reflector is much greater than its vertical width in order to realize a low side lobe characteristic of a horizontal plane. However, in the technology of Patent Document 1 described above, it is not possible to realize the low side lobe characteristic of the horizontal plane since the reflector is formed so that the shape when the peripheral portion is viewed from the focus position of the offset parabolic reflector becomes substantially circular.

In other words, in the technology of Patent Document 1, it is not possible to realize the superiority of the elliptical reflector antenna in which the horizontal width and the vertical width of the reflector are greatly different.

Further, the technology of Non-Patent Document 1 realizes the low side lobe characteristic by causing the reflector to be elliptical, but optimal illuminance efficiency cannot be obtained in this technology since the elliptical shape of the reflector does not match an isolux line of an elliptical beam.

Further, in the technology of Patent Document 2, in the antenna device of a multi-beam scheme in which a plurality of primary radiators share one reflector and radiate a beam in a plurality of directions, increase of the side lobe or the like is suppressed by causing the contour of the reflector to have a shape along the contour line corresponding to the aperture plane phase deviation caused by the mirror surface aberration. However, the mirror surface aberration is caused by a path difference being generated in radio waves due to a direction of the beam since the plurality of beams share the same reflector in the antenna device of a multi-beam scheme. Therefore, such a mirror surface aberration is specific to the antenna device of a multi-beam scheme, and is not theoretically generated in an antenna device of a single beam scheme. Therefore, even when the technology of Patent Document 2 is known, the technology cannot be applied to technology for enhancing the irradiation efficiency, the spillover, the side lobe characteristic, and the like in the antenna device of a single beam scheme.

The present invention has been made in view of such circumstances and an object of the present invention is to provide an antenna device of a single beam scheme which has small spillover due to good irradiation efficiency of a reflector and an excellent low side lobe characteristic.

Means for Solving the Problem

In order to achieve the object described above, an antenna device according to the present invention is an antenna device of a single beam scheme, including: a reflector which forms an offset antenna with a portion of a rotational paraboloid being cut out; and a primary radiator which radiates a beam having an elliptical cone shape to an aperture plane of the reflector, wherein a contour of the aperture plane of the reflector is formed along an isolux line of the beam having the elliptical cone shape radiated from the primary radiator.

Further, an antenna device according to the present invention is an antenna device of a single beam scheme, including: a reflector which forms an offset antenna with a portion of a rotational paraboloid being cut out; a sub-reflector which radiates a beam having an elliptical cone shape to an aperture plane of the reflector; and a primary radiator which radiates a beam having any shape to the sub-reflector, wherein a contour of the aperture plane of the reflector is formed along an isolux line of the beam having an elliptical cone shape radiated from the sub-reflector.

Effects of the Invention

According to the antenna device according to the present invention, since the contour of the reflector is formed along the isolux line of the elliptical beam radiated from the primary radiator, it is possible to optimize a trade-off relationship of the spillover and the irradiation efficiency. As a result, it is possible to achieve reduction of a loss due to spillover, improvement of irradiation efficiency, enhancement of a side lobe characteristic, and the like and to improve antenna performance.

EMBODIMENTS FOR CARRYING OUT THE INVENTION

[Outline]

The antenna device of the present invention is an antenna device of a single beam scheme including one reflector and one primary radiator and is characterized in that a contour of the reflector is determined so that an illuminance of a beam from the primary radiator has a constant value along a contour of the reflector. In other words, in the antenna device of the present invention, the contour of the reflector is determined along a contour line (i.e., an isolux line) of an amplitude distribution of an illuminance of a beam radiated from the primary radiator.

First Embodiment

Figure 1:
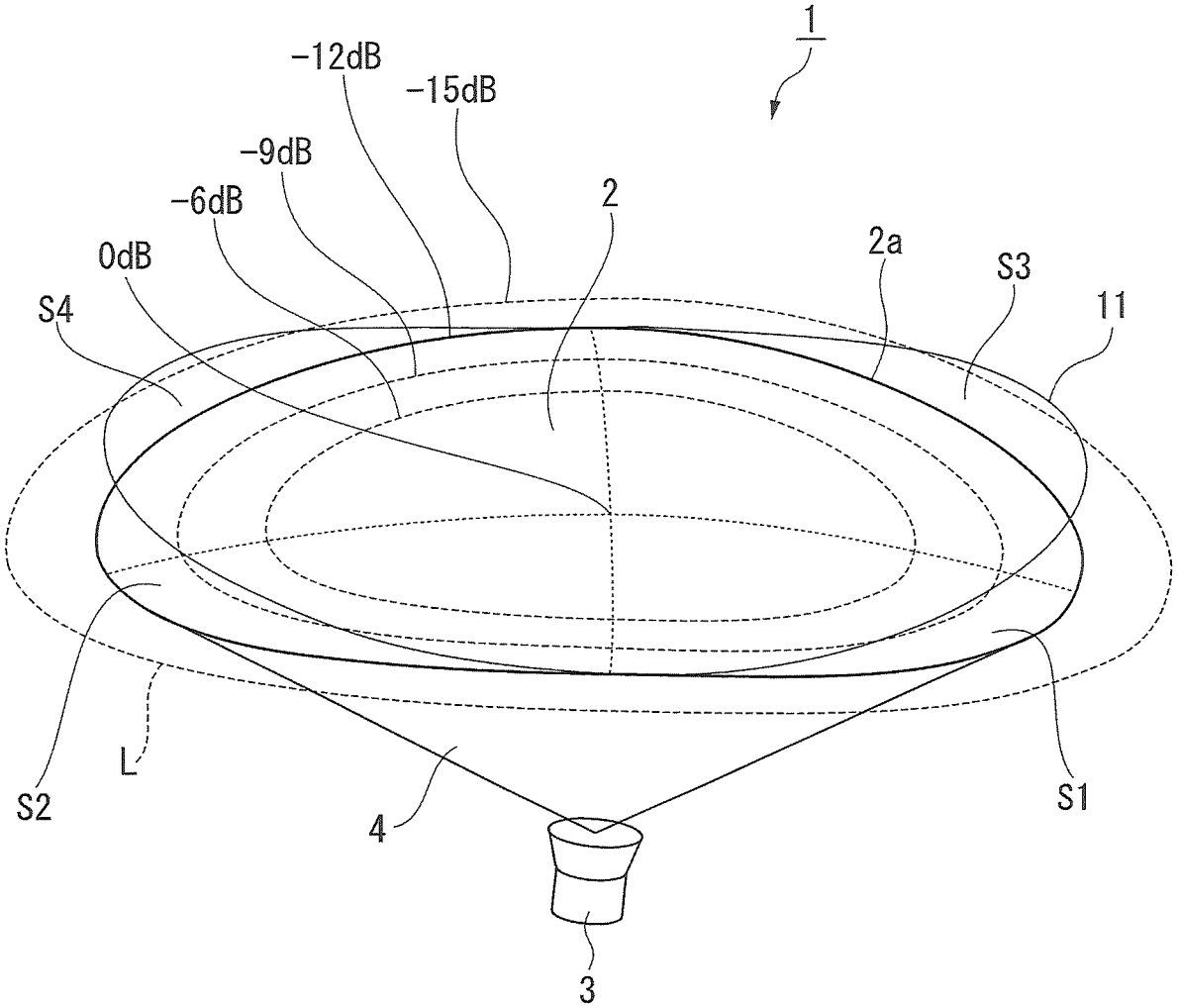
FIG. 1 is a diagram illustrating a schematic configuration and an isolux line of an antenna device of a single beam scheme according to a first embodiment of the present invention.

FIG. 1 is a diagram illustrating a schematic configuration and an isolux line of an antenna device of a single beam scheme according to a first embodiment of the present invention. The antenna device 1 includes a reflector 2 and a primary radiator 3, as illustrated in FIG. 1. Further, a mirror surface of the reflector 2 is a portion of a rotational paraboloid. Further, FIG. 1 illustrates a parabola in which an isolux line L on the rotational paraboloid is −6 dB, −9 dB, −12 dB, or −15 dB with an illuminance in a maximum direction (a center of an ellipse) of the elliptical beam 4 of the primary radiator 3 being 0 dB.

The primary radiator 3 is arranged in such a manner that a phase center of the primary radiator 3 matches a focus of the rotational paraboloid. Further, a central axis of the elliptical beam 4 of the primary radiator 3 forms a predetermined angle (e.g., 50 degrees) with a rotation axis of the rotational paraboloid. In this case, the illumination of the elliptical beam 4 radiated from the primary radiator 3 to the reflector 2 determines a shape of a reflector contour 2*a* of the present embodiment along a contour line (isolux line) which is the same value on the mirror surface of the reflector 2. For example, the isolux line in which the illumination is −12 dB is the reflector contour 2*a* of the present embodiment, as illustrated in FIG. 1.

Further, in this antenna device 1, the reflector 2 has a long elliptical shape whose horizontal width is much greater than its vertical width in order to realize a low side lobe characteristic of the horizontal plane. Generally, as the horizontal width of the reflector 2 is great, a relative level of the side lobe becomes low, and specifically, a ratio of the horizontal width and the vertical width is 2:1. Further, a reason for a non-circular beam is that, when the vertical width increases similarly to the horizontal width, a swept area of the antenna device 1 increases and a structural limitation at the time of installation of the antenna device 1 increases. Further, in this type of antenna device 1, the low side lobe is unnecessary for a vertical plane (a direction of a vertical width). Therefore, the beam radiated from the primary radiator 3 is the elliptical beam 4 which is long in a horizontal direction and has a substantially elliptical shape in order to support the reflector 2 having a great horizontal width.

Further, a reflector contour 11 of a general offset parabolic antenna is illustrated in FIG. 1. The general reflector contour 11 determines a shape of the corresponding reflector 2 so that a shape of an aperture plane (a virtual plane perpendicular to an axis of a beam from the reflector 2) is elliptical. However, in the general offset parabolic antenna, the elliptical reflector contour 11 is not related to an isolux line at all.

In other words, in the elliptical offset type reflector having the horizontal width greater than the vertical width, a general antenna device reduces the irradiation efficiency since a deviation of the elliptical shape is large as illustrated in FIG. 1 between the general reflector contour 11 and the reflector contour 2*a* of the present embodiment.

On the other hand, in the case of the antenna device 1 of the present embodiment, a loss due to spillover is the sum of powers of portions with which the reflector 2 is not irradiated, of the elliptical beam 4 of the primary radiator 3, but in this case, the sum of the powers is equal to or less than a certain level (−12 dB). Generally, the loss due to the spillover depends on a size of power radiated to the outside of the reflector contour 2*a* of the present embodiment. Therefore, it is effective to reduce the illumination (the isolux line) of the reflector contour 2*a* of the present embodiment in order to reduce the loss due to the spillover.

Meanwhile, the power of the elliptical beam 4 with which the reflector 2 is irradiated from the primary radiator 3 is a sum of powers equal to or higher than a certain level (−12 dB). Generally, it is effective to increase the illumination of the reflector contour 2*a* in order to enhance the irradiation efficiency of the reflector 2. Therefore, it is possible to maximize the irradiation efficiency of the antenna device 1 since it is possible to efficiently optimize the trade-off relationship of the loss due to the spillover and the irradiation efficiency of the reflector 2 when the illumination of the reflector contour 2*a* is at a certain level.

Further, since the reflector contour 2*a* of the present embodiment and the general reflector contour 11 are displayed side by side in FIG. 1, improvements with regard to the spillover or the irradiation efficiency by the present embodiment can be confirmed. In other words, spaces S1 and S2 in which the reflector contour 2*a* of the present embodiment protrudes from the general reflector contour 11 are spaces in which the antenna device 1 of the present embodiment contributes to the loss due to the spillover generated in a conventional antenna device. Further, spaces S3 and S4 in which the general reflector contour 11 protrudes from the reflector contour 2*a* of the present embodiment are spaces in which the antenna device 1 of the present embodiment contributes to reduction of the irradiation efficiency generated in the conventional antenna device.

Figure 2:
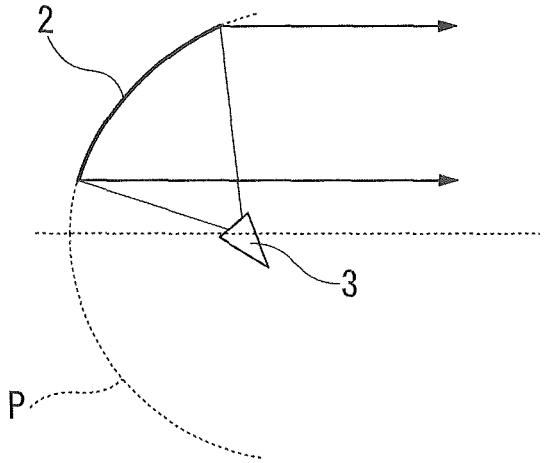
FIG. 2 is an illustrative diagram of the antenna device of a single beam scheme according to the first embodiment of the present invention.

FIG. 2 is an illustrative diagram of the antenna device of a single beam scheme according to the first embodiment of the present invention. In other words, the reflector 2 is the offset antenna in which a portion of the rotational paraboloid P is cut out receives the beam (elliptical beam) in an elliptical cone shape from the primary radiator 3 in the focus position of the reflector 2, and reflects a beam of a parallel line from the reflector 2. The shape of the contour of the reflector 2 is a locus of the isolux line when the reflector 2 is irradiated with the elliptical beam from the primary radiator 3, as illustrated in FIG. 1. For example, the shape of the contour of the reflector 2 is a locus of the isolux line of −12 dB when the center of the elliptical beam has 0 dB. Accordingly, improvements with regard to the spillover, the irradiation efficiency, the low side lobe characteristic, and the like are possible in comparison with the general antenna device.

Second Embodiment

Figure 3:
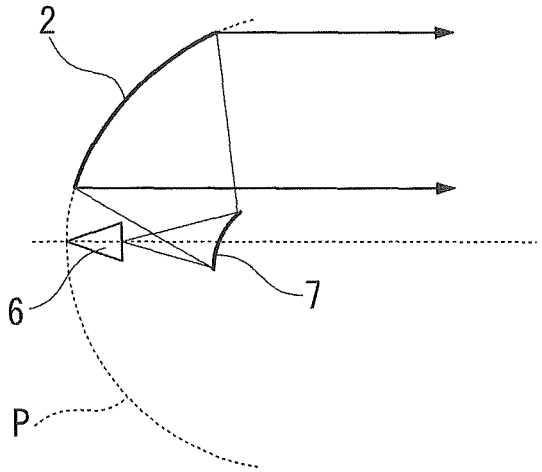
FIG. 3 is an illustrative diagram of an antenna device of a single beam scheme according to a second embodiment of the present invention.

FIG. 3 is an illustrative diagram of an antenna device of a single beam scheme according to a second embodiment of the present invention. In the antenna device of the second embodiment, the shape of the contour of the reflector 2 becomes the locus of the isolux line, as in FIG. 1. Further, the second embodiment is the same as the first embodiment in that the reflector 2 is the offset antenna in which a portion of a rotational paraboloid P is cut out. A characteristic of the antenna device of the second embodiment is that the primary radiator 3 illustrated in FIG. 2 is replaced with a primary radiator system including a primary radiator 6 and a sub-reflector 7 as illustrated in FIG. 3.

In other words, in the primary radiator system, when the sub-reflector 7 is irradiated with a beam having any shape from the primary radiator 6, the reflector 2 is irradiated with a beam (elliptical beam) having an elliptical cone shape from the sub-reflector 7. In this case, the shape of the contour of the reflector 2 is set so that an illuminance in the contour of the reflector 2 of the elliptical beam irradiated from the sub-reflector 7 is constant. In the antenna device of the second embodiment, improvements with regard to the spillover, the irradiation efficiency, the low side lobe characteristic, and the like are possible in comparison with the general antenna device, similar to the first embodiment.

Third Embodiment

In an antenna device according to a third embodiment of the present invention, the shape of the sub-reflector 7 of the second embodiment illustrated in FIG. 3 is determined by an isolux line in which an illuminance on the sub-reflector 7 due to the beam (elliptical beam) having an elliptical cone shape radiated from the primary radiator 6 is constant. In other words, the contour of the sub-reflector is formed along the isolux line of the elliptical beam, similar to the contour of the reflector 2. Accordingly, it is possible to maximize efficiency of the entire antenna device since mitigation of the loss due to the spillover in the sub-reflector 7 and optimal design of the irradiation efficiency can be realized, in addition to the effects of the first embodiment and the second embodiment.

As described above, according to the antenna devices according to the embodiments of the present invention, since a design for optimizing the trade-off relationship between the spillover and the irradiation efficiency can be performed, it is possible to improve efficiency of the entire antenna in comparison with a general antenna device. It is also possible to enhance the side lobe characteristic in a horizontal direction without increasing a load applied to the antenna device during a typhoon. It is also possible to achieve further miniaturization of the reflector since the efficiency of the antenna device is improved. Further, in the antenna device using a double reflector, it is possible to improve efficiency of the sub-reflector.

While the embodiments of the antenna device according to the present invention have been described in detail with reference to the drawings, the concrete configuration of the present invention is not limited to the content of the embodiments described above, and a change in design without departing from the scope and spirit of the present invention is included in the present invention.

Priority is claimed on Japanese Patent Application No. 2011-184904, filed Aug. 26, 2011, the content of which is incorporated herein by reference.

INDUSTRIAL APPLICABILITY

The antenna device of the present invention can be effectively used for a point-to-point communication system such as a mobile backhaul as a parabolic antenna or an offset parabolic antenna of a single beam scheme.

DESCRIPTION OF REFERENCE SYMBOLS

1 antenna device
2 reflector
2*a* reflector contour of the present embodiment
3 first radiator
4 elliptical beam
6 first radiator
7 sub-reflector
11 general reflector contour
S1 space contributing to loss due to spillover
S2 space contributing to loss due to spillover
S3 space contributing to degradation of irradiation efficiency
S4 space contributing to degradation of irradiation efficiency
L isolux line on rotational paraboloid
P rotational paraboloid

The invention claimed is:

1. An antenna device of a single beam scheme, comprising:
a reflector configured to form an offset antenna with a portion of a rotational paraboloid being cut out; and
a primary radiator configured to radiate a beam having an elliptical cone shape to an aperture plane of the reflector,
wherein a contour of the aperture plane of the reflector is formed along an isolux line of the beam having the elliptical cone shape radiated from the primary radiator,
wherein:
when a contour formed in the aperture plane of the reflector along the isolux line of the beam having an elliptical cone shape radiated from the primary radiator is a first contour, and a virtual elliptical contour formed to be perpendicular to an axis of the beam incident on the aperture plane of the reflector is a second contour,
a space in which the first contour protrudes from the second contour is a space which compensates for a loss due to spillover of the reflector.

2. An antenna device of a single beam scheme, comprising:
a reflector configured to form an offset antenna with a portion of a rotational paraboloid being cut out;
a sub-reflector configured to radiate a beam having an elliptical cone shape to an aperture plane of the reflector; and
a primary radiator configured to radiate a beam having any shape to the sub-reflector,
wherein a contour of the aperture plane of the reflector is formed along an isolux line of the beam having an elliptical cone shape radiated from the sub-reflector,
wherein:
when a contour formed in the aperture plane of the reflector along the isolux line of the beam having an elliptical cone shape radiated from the primary radiator is a first contour, and a virtual elliptical contour formed to be perpendicular to an axis of the beam incident on the aperture plane of the reflector is a second contour,
a space in which the first contour protrudes from the second contour is a space which compensates for a loss due to spillover of the reflector.

3. The antenna device according to claim 2, wherein:
the primary radiator radiates the beam having an elliptical cone shape to the sub-reflector, and
a contour of the aperture plane of the sub-reflector is formed along an isolux line of the beam having an elliptical cone shape radiated from the primary radiator.

4. The antenna device claim 1, wherein the contour of the aperture plane of the reflector is formed along an isolux line of −12 dB when an illuminance of a central portion of the beam having an elliptical cone shape radiated from the primary radiator is 0 dB.

5. The antenna device according to claim 1, wherein a space in which the second contour protrudes from the first contour is a space which compensates for degradation of illuminance efficiency of the reflector.

6. The antenna device according to claim 1, wherein, in each of an ellipse of the first contour and an ellipse of the second contour, a ratio of a horizontal width and a vertical width is substantially 2:1.

7. The antenna device according to claim 1, wherein a central axis of the beam having an elliptical cone shape radiated from the primary radiator to the aperture plane of the reflector forms a predetermined angle with a rotational axis of the rotational paraboloid.

8. The antenna device according to claim 1, wherein the beam having an elliptical cone shape radiated from the primary radiator to the aperture plane of the reflector exhibits an ideal Gaussian distribution characteristic.

9. The antenna device according to claim 1, being used for a point-to-point communication system including a mobile backhaul.

* * * * *